United States Patent [19]

Karlsson

[11] 4,295,507

[45] Oct. 20, 1981

[54] LIMBING AND BARKING DEVICE

[76] Inventor: Einar Karlsson, 1208 Abyn, Burträsk, Sweden, S-937 00

[21] Appl. No.: 103,943

[22] Filed: Dec. 14, 1979

[30] Foreign Application Priority Data

Dec. 21, 1978 [SE] Sweden ..... 7813195

[51] Int. Cl.[3] ..... B27L 1/00

[52] U.S. Cl. ..... 144/208 B; 144/2 Z

[58] Field of Search ..... 144/2 Z, 208 R, 208 B, 144/311, 208 F

[56] References Cited

U.S. PATENT DOCUMENTS

| | | | |
|---|---|---|---|
| 2,125,529 | 8/1938 | Ullgren | 144/208 B |
| 3,385,331 | 5/1968 | Bronemo et al. | 144/2 Z |
| 3,489,190 | 1/1970 | Voronitsyn et al. | 144/2 Z |
| 3,624,756 | 11/1971 | Mellgren | 144/2 Z |

FOREIGN PATENT DOCUMENTS

| | | | |
|---|---|---|---|
| 98258 | 3/1940 | Sweden | 144/208 B |
| 163834 | 8/1963 | U.S.S.R. | 144/208 B |
| 285215 | 4/1971 | U.S.S.R. | 144/208 B |

*Primary Examiner*—W. D. Bray

*Attorney, Agent, or Firm*—Cushman, Darby & Cushman

[57] ABSTRACT

Apparatus for delimbing and barking trees or tree parts comprising a downwardly tapering trough for receiving the trees or tree parts, the trough having a generally horizontal axis and having one side formed by an upwardly and outwardly inclined endless conveyor which includes drivers projecting therefrom for circulating the trees or tree parts in the trough and for transporting wood upwardly; at least one elongated delimbing roll arranged parallel to the axis of the trough at the bottom thereof, the roll being adjacent the lower end of the conveyor and rotatable in a direction such that its upper surface rotates toward the conveyor; and at least one elongated barking roll arranged in side-by-side parallel relationship to the delimbing roll on the side thereof opposite the conveyor and rotatable in a direction such that its uper surface rotates toward the delimbing roll, the barking roll having longitudinally extending planar peripheral ribs for orienting the stems of the trees or tree parts into parallelism with the barking and delimbing rolls.

4 Claims, 3 Drawing Figures

LIMBING AND BARKING DEVICE

This invention relates to a device for the limbing and barking of trees and parts of trees.

In the felling of above all small trees, for example in thinning, the limbing costs constitute a large part of the total costs. In view of the risk of great damages on the remaining trees, besides, it is not suitable to enter the stand with large final felling machines.

A possible solution is to collect unlimbed trees in bundles and to pull them out of the stand by gently operating equipment. Outside the stand, the trees must be limbed without disassembling the bundles, because unlimbed trees hook one into the other by their branches and render it expensive and tedious to separate single stems.

Small conifers cannot be barked in large barking systems, because they easily are broken in such systems. It would, therefore, be of great value to be able also to bark conifers in an acceptable way, the more so as softwood has a higher value than other mixed raw material. The present invention, therefore, has the object to provide a device, which can limb bundles also of small tree stems without requiring their prior separation, at the same time as a satisfactory barking result, at least with respect to softwood is obtained. This object is achieved by means of a device having the characterizing features defined in the attached claims.

Figure 1:
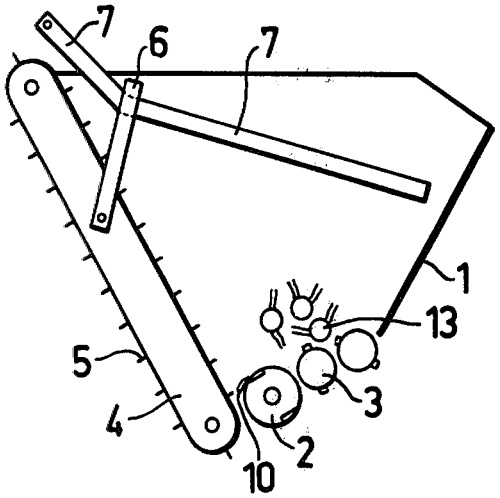
Figure 2:
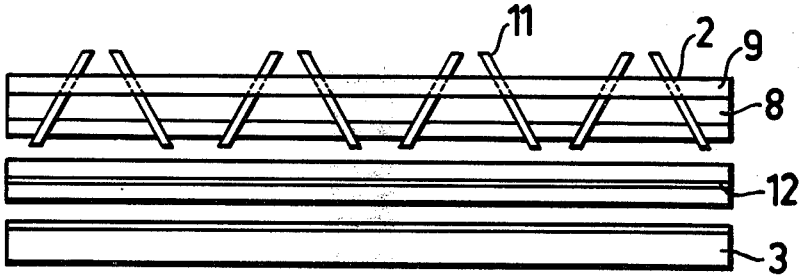
Figure 3:
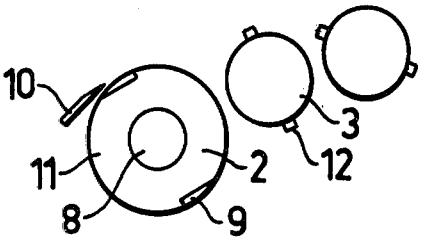

An embodiment of the invention is described in the following, with reference to the accompanying drawing, in which FIG. 1 is a section through the device, FIG. 2 is a view of the active limbing members of the device, and FIG. 3 is a section through the active lifting members.

The equipment or device according to the invention comprises a downward tapering through 1, at the bottom of which a plurality of co-acting working limbing and barking rolls 2 and 3 are provided, which in the embodiment shown are two barking rolls 3 and one limbing roll 2. On one side of the trough a series of conveyors 4 are located to which drivers 5 are attached. On each conveyor foldable strippers 6 are mounted. On the upper side of the trough a gate 7 is suspended in hinged connection at one end.

The limbing roll 2 consists of a carrying axle 8, on which a plurality of angular plates 11 are attached, which are shaped so as to project from the axle. Along the limbing roll 2 cutting members or knives 9 are attached to said plates 11.

The barking rolls 3 consist of a pipe with steel ribs 12 running along the same. When unlimbed wood is dropped down into the trough 1, the wood meets the barking rolls 3, which in FIG. 1 rotate counter-clockwise. The ribs 12 meet the wood and move it to the left in FIG. 1, while at the same time scraping the wood surface whereby bark and some knots are removed. As the ribs 12 first meet that portion of the wood 13 which is located farthest to the right in FIG. 1 and move this portion to the left, the ribs 12 contribute to orienting the wood, i.e. the stems, in the longitudinal direction of the barking rolls. The rolls 3, thus, move the wood against the limbing roll 2, which rotates counter-clockwise, i.e. in the same direction as the barking rolls 3. The stems 13 are carried on the limbing roll 2 by the plates 11, while knots remaining on the stems can enter between the plates. The cutting members 9 thereby cut off projecting knots. At the rotation of the limbing roll 2 the inclined plates 11 swing reciprocatingly and cut off knots, preferably such located along the stems. The limbing roll 2 also cuts up long branches and discharges them as loose pieces out of the trough 1.

The wood 13 is fed by the barking rolls 3 and limbing roll 2 to the conveyor 4, the drivers 5 of which transport the wood 13 upward to the stripper 6, which removes the wood from the drivers 5, so that the wood drops down onto wood lying beneath and substantially against the opposite side of the trough 1. The drivers also have the function of stirring or circulating the trees or tree parts in the trough.

The gate 7 rests against the upper side of the wood and cushions the movements of the wood, so that single pieces do not place themselves angularly relative to other wood. Due to a high rotation speed of the barking rolls 3 and limbing roll 2, and to a rapid upward transport via the conveyor 4, even a great number of stems can be limbed and also be barked entirely or partially within a short time.

What I claim is:

1. Apparatus for delimbing and barking trees or tree parts comprising a downwardly tapering trough for receiving the trees or tree parts, said trough having a generally horizontal axis and having one side formed by upwardly and outwardly inclined endless conveyor means which includes drivers projecting therefrom for circulating the trees or tree parts in the trough and for transporting wood upwardly; at least one elongated delimbing roll arranged parallel to the axis of the trough at the bottom thereof, said roll being adjacent the lower end of said conveyor means and rotatable in a direction such that its upper surface rotates toward said conveyor means; and at least one elongated barking roll arranged in side-by-side parallel relationship to said delimbing roll on the side thereof opposite said conveyor means and rotatable in a direction such that its upper surface rotates toward said delimbing roll, said barking roll having longitudinally extending planar peripheral ribs for orienting the stems of the trees or tree parts into parallelism with the barking and delimbing rolls.

2. Apparatus as in claim 1 including stripper means located near the upper end of the conveyor means for removing wood from the conveyor means.

3. Apparatus as in claim 1 or 2 including hinged gate means located near the top of the trough for resting against the upper side of the trees or tree parts as an aid in preventing angular movement of the latter relative to each other.

4. Apparatus as in claim 1 or 2 wherein the delimbing roll includes an axle which carries a plurality of plates in spaced-apart relationship along the axle, the plates projecting from the axle and being inclined relative to the axis of the axle, the delimbing roll also including a plurality of circumferentially spaced-apart knives extending axially along the length of the axle and attached to said plates.

* * * * *